US006327977B1

(12) United States Patent
Zimmer

(10) Patent No.: US 6,327,977 B1
(45) Date of Patent: Dec. 11, 2001

(54) CLEANING DEVICE FOR A BACKING OF A PRINTING MACHINE

(75) Inventor: Peter Zimmer, Kufstein (AT)

(73) Assignee: Peter Zimmer KEG, Kufstein (AT)

( * ) Notice: Subject to any disclaimer, the term of this patent is extended or adjusted under 35 U.S.C. 154(b) by 0 days.

(21) Appl. No.: 09/284,386

(22) PCT Filed: Aug. 12, 1998

(86) PCT No.: PCT/AT98/00189

§ 371 Date: Apr. 13, 1999

§ 102(e) Date: Apr. 13, 1999

(87) PCT Pub. No.: WO99/08874

PCT Pub. Date: Feb. 25, 1999

(30) Foreign Application Priority Data

Aug. 18, 1997 (AT) ..... 1378/97

(51) Int. Cl.[7] ..... B41F 35/00
(52) U.S. Cl. ..... 101/424; 101/425
(58) Field of Search ..... 101/424, 425, 101/423, 483; 15/256.52, 256.51, 256.5

(56) References Cited

U.S. PATENT DOCUMENTS 2,648,088 * 8/1953 Bailey ..... 101/425
2,858,576 * 11/1958 Rose ..... 101/425
3,737,940 * 6/1973 Moestue et al. ..... 101/425
3,942,889 * 3/1976 Kurita et al. ..... 355/15
4,217,819 * 8/1980 Von Tluck et al. ..... 101/483

FOREIGN PATENT DOCUMENTS

2040811 * 9/1980 (GB) ..... 101/425

OTHER PUBLICATIONS

U. Rutz: "Das okologishe Umfeld von Druckmaschinen", TEXTILVEREDLUNG, vol. 30, No. 3/4, pp. 79–81.

* cited by examiner

*Primary Examiner*—John S. Hilten
*Assistant Examiner*—Anthony H. Nguyen
(74) *Attorney, Agent, or Firm*—Lorusso & Loud

(57) ABSTRACT

The present invention relates to a cleaning device for cleaning the back cloth of a printing machine and more precisely a textile printing machine, wherein said cleaning device comprises at least one rotor provided with tines for cleaning the back cloth. The tines of the rotor are traditionally made in the shape of flexible strips. During the operation, said strips abut the back cloth and sweep it on a portion of their length due to the centrifugal force.

23 Claims, 1 Drawing Sheet

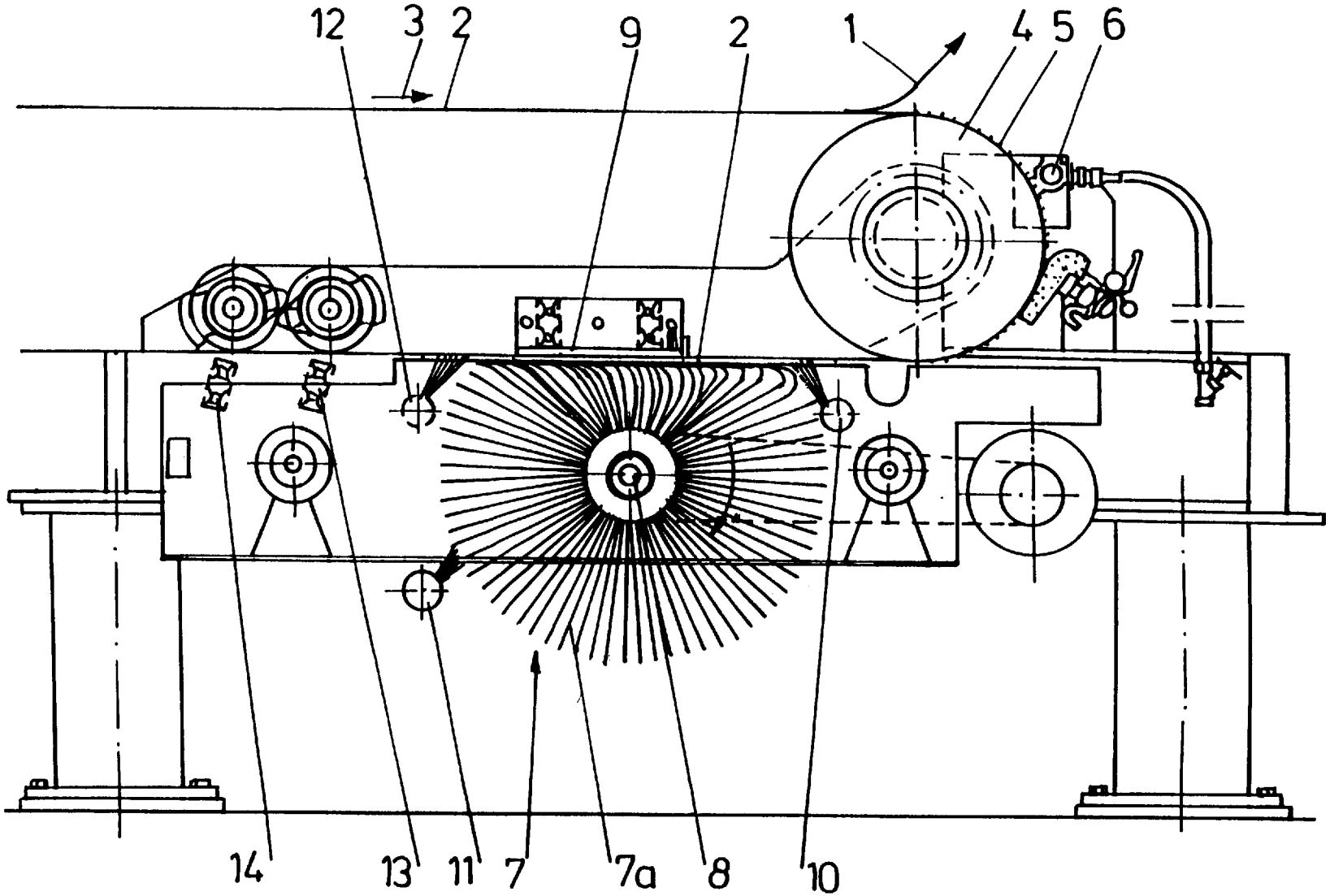
6
5
4
1
2
9
2
3
12
10
8
7a
7
11
13
14

CLEANING DEVICE FOR A BACKING OF A PRINTING MACHINE

The invention relates to a cleaning apparatus for a backing of a printing machine, in particular a textile printing machine, wherein the cleaning apparatus is provided with at least one rotor with rotor bristles for cleaning the backing.

With printing machines, in particular textile printing machines, a backing is used as an underlay for the products to be printed, for example a textile web, which is preferably composed of fibre-reinforced rubber or plastics. The product is stuck, preferably with a water-soluble (or non-water-based) glue onto the backing. When the product is removed, fluff and remnants of glue remain on the backing. In order to remove these and to prevent a build up of fluff, glue and dye, it is already known to clean the backing. A known cleaning apparatus is provided, in the area of a guide roller for guiding the backing, with an irrigation and a sponge extending over the entire width of the backing, which together with the irrigation makes a pre-wetting and a process of softening the water-soluble glue possible. Following this there is located a brushing mechanism with brushes and with a relatively small diameter, for example in the order of approximately 25 cm.

In order to improve the cleaning action, the invention proposes that the rotor bristles are configured as limp, flexible strips—as known per se—which in operation strike and wipe along the backing along a part of their length due to centrifugal action.

Rotors with limp, flexible strips are known in principle per se, and are used, for example, in automatic car washes. "Limp, flexible" is understood as strips which are of relatively soft material and therefore hang down limply under their own weight when the rotor is inoperative. Only by means of the rotational movement of the rotor and by means of centrifugal action do the strips project radially outwards from the rotor, before they meet with the backing. Because of the relatively large diameter of such a rotor with limp flexible strips, the strips strike the backing with a high peripheral speed and thus also remove stuck on fluff, glue remnants and dye remnants as well as other soiling (whip effect), wherein the rubbing along, that is to say the wiping of the strips along the backing is also important for the cleaning effect.

The limp flexible strips can, for example, have a circular or rectangular profile, and advantageously have a large length such that the standard distance of the axis of rotation of the rotor from the backing is approximately 30 to 70% of the length of the strips. It is advantageous when the flexibly configured rotor bristles are composed of mono-filament, multi-filament, twisted and/or rough surfaced strips.

Further advantages and details will be explained in more detail with reference to the following description of the drawing.

The FIGURE shows, in a schematic view from the side, an embodiment of a cleaning apparatus according to the invention.

The printed product 1 runs on a backing 2 in the direction of the arrow 3 until just in front of the guide roller 4. Here, the product previously stuck by means of a water-soluble glue to the fibre-reinforced backing is removed. When removal takes place, fluff, glue and dye remnants remain on the backing. This soiling is indicated by dots 5 in the drawing. In order to clean the backing, an irrigation 6 (as known) is provided in the upper area of the guide roller 4. In the lower area there is located a sponge 6*a* extending over the entire width, which together with the irrigation makes a pre-wetting and a process of softening the water-soluble glue possible.

On the underside, the rotor 7, configured according to the invention, is located in the return path of the backing on its way to a gluing mechanism, which is not shown, the rotor bristles of which rotor are configured as limp, flexible strips 7*a*.

The FIGURE shows the operating condition in which the strips are pressed radially outwards by centrifugal action. The strips 7*a* strike the fluff and other dirt particles off the backing and moreover clean it by means of a wiping effect, in that they rub along the backing. They come into contact with the backing with a large part of their length, as the distance of the axis of rotation 8 of the rotor 7 from the backing 2 is less than the length of the strips. Preferably, this standard distance varies within the range of 30 to 70% of the strip length, but it is yet more advantageous when this numerical value varies within the range of between 40 and 60% and highly preferred at approximately 50% of the length of the strips. When the machine is inoperative, the rotor still rotates for several seconds, wherein the fresh water supply still to be described is maintained, in order to rinse adhering glue from the strips 7*a*. When the rotor is still, the limp strips 7*a*, preferably made from plastics, fall down as a result of gravity, whereby there is a state of non-contact between the rotor and backing when—as is the case with the embodiment shown—the rotor 7 is arranged below the backing 2.

The speed of rotation of the rotor 7 is preferably between 50 rpm and 300 rpm, preferably approximately 120 rpm. The rotation speed can, however, vary depending on the strip length, when space under the printing machine is not available for accommodating a large rotor two smaller rotors are installed on behind the other, which can then have a smaller diameter. Such smaller rotors are then advantageously operated at a somewhat higher rotational speed.

On the inside of the backing 2—opposite the rotor 7—there is provided a stay 9, preferably configured as a sliding plate, which prevents sagging, swinging and vibrating of the backing.

The direction of rotation of the rotor with the limp, flexible strips 7*a* is selected such that the backing and the strips move in opposite directions in the area of contact. A relatively wide contact surface (area of abrasion) is consequently produced, whereby the fluffy material and other soiling such as glue remnants or, excess dye adhering to the backing are reliably removed in one working operation.

Irrigation arrangements which operate with as much water as possible are also advantageous for the cleaning. With the embodiment shown, three irrigation arrangements are provided. The first irrigation arrangement 10 operates with circulating water which is supplied by means of a pump, which is not shown, and a filter, and delivers the water in front of the rotor to the top surface of the backing 2. The second irrigation arrangement 11 also operates with circulating water and delivers its water directly onto the circulating strips 7*a*. The delivery rate of the pump is advantageously more than 500 l/min, preferably approximately 1000 l/min. In this way a sufficient supply of water to the cleaning area is guaranteed. Following on from the rotor—with respect to the direction of movement of the backing 2—there is a further water supply 12, which in contrast to the water supplies 10 and 11, is not supplied with circulating water, but instead with fresh water in order to rinse the backing clean. By using circulating water on the other hand, water can be saved. Moreover, the cleaning power thereof is greater.

Two following drying squeegee devices 13 and 14 provide a drier backing, whereby the undesired carrying along of water into the subsequent gluing mechanism, which is not shown, is prevented. In the gluing mechanism, which is not shown, a web of product is again glued on in a manner known per se, and then conveyed to the printing process together with the backing.

By means of the cleaning according to the invention, the backing can be used over a long period of time. The build-up—despite the cleaning apparatuses known until now—of dye, fluff and glue remnants on the backing is reliably prevented so that the cleaning process using acetone, which was necessary until now, which involves considerable danger, can be avoided.

What is claimed is:

1. A cleaning apparatus for a backing of a printing machine comprising:

at least one rotor having a circumferential outer surface;

wherein said at least one rotor is mounted by at least one axle adjacent to a backing path so that at least one central axis of said at least one rotor is oriented perpendicularly to a backing path direction in a plane which is approximately parallel to a plane of said backing path;

wherein said at least one rotor is mounted at a mounting distance which is the orthogonal distance between a closest tangent line of said circumferential outer surface and said backing path;

a plurality of rotor bristles each having a fixed end and a free end and a bristle length;

wherein said fixed end of each of said rotor bristles is attached to said circumferential outer surface of said at least one rotor such that said free end is capable of extending radially from said at least one rotor in response to any centrifugal force caused by a rotation of said rotor;

and wherein each of said rotor bristles comprises a limp flexible strip;

wherein said mounting distance is about substantially less than said bristle length;

and further comprising means to provide a rotational force to said rotor to operate said apparatus so that a segment of each of said bristles lengths strikes and wipes along the backing.

2. A cleaning apparatus according to claim 1 wherein said rotor bristles comprise any one of the group consisting essentially of mono-filament strips, multi-filament strips, twisted strips and surface structured strips.

3. A cleaning apparatus according to claim 1 wherein said rotor bristles comprise any two of the group consisting essentially of mono-filament strips, multi-filament strips, twisted strips and surface structured strips.

4. A cleaning apparatus according to claim 1 wherein said rotor bristles comprise any three of the group consisting essentially of mono-filament strips, multi-filament strips, twisted strips and surface structured strips.

5. A cleaning apparatus according to claim 1 wherein said rotor bristles comprise essentially mono-filament strips, multi-filament strips, twisted strips and surface structured strips.

6. A cleaning apparatus according to any one of claims 1–5 wherein said mounting distance is about between 30% and 70% of said bristle length.

7. A cleaning apparatus according to any one of claims 1–5 wherein said mounting distance is about between 40% and 60% of said bristle length and preferably about 50% of said bristle length.

8. A cleaning apparatus according to any one of claims 1–5 wherein said at least one rotor has a rotational speed of about between 50 rotations per minute and 300 rotations per minute and preferably about 120 rotations per minute.

9. A cleaning apparatus according to claim 6 wherein said at least one rotor has a rotational speed of about between 50 rotations per minute and 300 rotations per minute and preferably about 120 rotations per minute.

10. A cleaning apparatus according to claim 7 wherein said at least one rotor has a rotational speed of about between 50 rotations per minute and 300 rotations per minute and preferably about 120 rotations per minute.

11. A cleaning apparatus according to claim 1 wherein a stay is mounted adjacent and about parallel to said backing path proximate to a second side of the backing and opposite said at least one rotor wherein said bristles strike a first side of the backing so that said stay provides support for a section of backing while the section of backing is being cleaned.

12. A cleaning apparatus according to claim 1 wherein at least one backing water supply outlet is mounted proximate to a rotor side of said backing wherein said at least one backing water supply outlet directs a flow of water onto a section of the rotor side of said backing proximate to said at least one rotor.

13. A cleaning apparatus according to claim 1 wherein at least one rotor water supply outlet is mounted proximate to said rotor and wherein said rotor water supply outlet directs a flow of water onto said plurality of bristles.

14. A cleaning apparatus according to claim 1 wherein at least one backing water supply outlet is mounted is mounted proximate to a rotor side of said backing wherein said at least one backing water supply outlet directs a flow of water onto a section of the rotor side of said backing proximate to said rotor;

and wherein at least one rotor water supply outlet is mounted proximate to said rotor so that said at least one water supply outlet directs a flow of water onto said plurality of bristles.

15. A cleaning apparatus according to claim 14 comprising;

at least one first backing water supply outlet providing a flow of water onto a section of the rotor side of said backing which is approaching said rotor;

at least one second backing water supply outlet providing a flow of water onto a section of the rotor of said backing which is moving away from said rotor; and at least one rotor water supply outlet providing a flow of water onto said bristles.

16. A cleaning apparatus according to any one of claims 12, 14 or 15 wherein any of said at least one backing water supply outlets which is mounted to direct a flow of water onto a section of the backing which is moving away of said at least one rotor is adapted to provide a flow of fresh water.

17. A cleaning apparatus according to any one of claims 12–15 wherein at least one of said backing water supply outlets and said rotor water supply outlets is in fluid communication with a pump and a filter wherein said pump and said filter are adapted to provide recirculating water.

18. A cleaning apparatus according to claim 16 wherein at least one of said backing water supply outlets and said rotor water supply outlets is in fluid communication with a pump and a filter wherein said pump and said filter are adapted to provide at least partially recirculating water.

19. A cleaning apparatus according to claim 17 wherein said pump has a delivery rate of about more than 500 liters per minute.

20. A cleaning apparatus according to claim 18 wherein said pump has a delivery rate of about more than 500 liters per minute.

21. A cleaning apparatus according to claim 1 wherein said at least one rotor has a direction of rotation which provides a bristle wiping direction which is opposite to a backing movement direction.

22. A cleaning apparatus according to claim 1 wherein said at least one rotor is mounted below said backing path.

23. A cleaning apparatus according to claim 1 wherein at least one drying squeegee is mounted against the backing across a rotor side of said backing path at a location in said backing path following said at least one rotor.

* * * * *